US009517440B2

(12) United States Patent
Luethi et al.

(10) Patent No.: US 9,517,440 B2
(45) Date of Patent: Dec. 13, 2016

(54) SAMPLE MIXING DEVICE

(75) Inventors: Beat Luethi, Zuerich (CH); Kai Schueler, Hoffeld (CH)

(73) Assignee: CTC ANALYTICS AG, Zwingen (CH)

( * ) Notice: Subject to any disclaimer, the term of this patent is extended or adjusted under 35 U.S.C. 154(b) by 954 days.

(21) Appl. No.: 13/283,709

(22) Filed: Oct. 28, 2011

(65) Prior Publication Data

US 2012/0107197 A1 May 3, 2012

(30) Foreign Application Priority Data

Nov. 1, 2010 (EP) ..... 10405207

(51) Int. Cl.
*B01F 11/00* (2006.01)

(52) U.S. Cl.
CPC ..... *B01F 11/0008* (2013.01); *B01F 11/0028* (2013.01)

(58) Field of Classification Search
CPC B01F 11/0005; B01F 11/0008; B01F 11/0014
USPC ..... 366/208, 209, 213, 214
See application file for complete search history.

(56) References Cited

U.S. PATENT DOCUMENTS

| | | | | |
|---|---|---|---|---|
| 791,664 | A * | 6/1905 | Wilson | 366/209 |
| 4,124,122 | A | 11/1978 | Emmitt | |
| 4,453,639 | A | 6/1984 | Sharma | |
| 4,848,917 | A * | 7/1989 | Benin et al. | 366/208 |
| 5,036,989 | A | 8/1991 | Carilli | |
| 5,417,922 | A | 5/1995 | Markin et al. | |
| 2005/0128863 | A1 * | 6/2005 | Esteve et al. | 366/110 |
| 2007/0163973 | A1 | 7/2007 | Smokowicz et al. | |
| 2009/0035825 | A1 * | 2/2009 | Kotler et al. | 435/91.2 |

FOREIGN PATENT DOCUMENTS

| | | | |
|---|---|---|---|
| CA | 2308414 | * | 5/1999 |
| DE | 20018633 | U1 | 1/2001 |
| EP | 0853493 | B1 | 10/2002 |
| EP | 1393797 | B1 | 7/2006 |
| GB | 2451491 | A | 2/2009 |

* cited by examiner

*Primary Examiner* — Charles Cooley
*Assistant Examiner* — Marc C Howell
(74) *Attorney, Agent, or Firm* — Birch, Stewart, Kolasch & Birch, LLP

(57) ABSTRACT

A device (1) for mixing a sample, in particular for an automatic chemical analysis instrument, comprises a receptacle device with at least two moveably guided container receptacles (21-24, 31.1), with each container receptacle (21-24, 31.1) comprising a support region for holding a sample container (41-44). The support regions of the two container receptacles (21-24, 31.1) are arranged at different heights in an operational state of the device (1).

8 Claims, 2 Drawing Sheets

SAMPLE MIXING DEVICE

TECHNICAL FIELD

The invention relates to a device for mixing a sample, comprising a receptacle device with at least a first and a second container receptacle, with each container receptacle comprising a support region for holding a sample container and a guidance device for laterally guiding the sample container.

PRIOR ART

Mixing devices for sample material are used, for example, in the laboratory for preparing samples prior to analysis and many variants thereof are known:

Thus, by way of example, EP 0 853 493 B1 (Dade Behring Inc.) shows a device for mixing liquids, in particular for an analysis instrument. A lower part of a container is guided on a circular path while the container is kept stationary, or vice versa. A centrifugal force is applied to a horizontal cam so that the latter tilts outward and deflects the central line of the container from its original, vertical orientation. A chemical analysis instrument comprises a carousel with sample containers and a cuvette carousel with cuvettes and a plurality of cartridges. A sample is displaced by means of an arm between the various containers, in particular to the vortex mixer.

EP 1 393 797 B1 (Hans Heidolph) relates to a shaking instrument with a drivable eccentric unit, which can be put into rotation. The eccentric unit comprises receptacles for vessels in the edge region of the eccentric unit. The receptacles are substantially formed as through openings in support elements, into which the vessels can be inserted. Here, the vessel holder can be designed such that vessels with arbitrary shapes can be held and, in particular, be arranged in a circle. To this end, the support elements are provided in an interchangeable fashion.

The mixing devices known from the prior art are disadvantageous in that they are only suitable to a limited extent for optimum mixing of different sample volumes. However, different volumes are typically required for the analysis, dependent on very different factors, in particular the concentration of the substance to be examined in the sample. Although a concentration of the substance can often be reduced by means of a dilution series, this may however also change the result of the analysis as a result of the changing matrix concentration. Increasing the concentration of the samples can also be associated with problems. By way of example, as a result of too low a solubility of certain substances, the substances to be examined, in particular, can also precipitate during concentrating. Concentrations of suspensions are not only difficult to establish but can also damage sensitive analysis instruments.

DESCRIPTION OF THE INVENTION

It is an object of the invention to develop a device for mixing a sample, which device is part of the technical field mentioned at the outset and is suitable for efficient mixing of different sample volumes.

The solution to the object is defined by the features of claim 1. According to the invention, a spacing between the support region and the guidance device of the first container receptacle differs from a spacing between the support region and the guidance device of the second container receptacle.

This allows sample containers with different heights to be respectively supported in an optimum fashion in a corresponding container receptacle. Sample containers with different heights are preferably held, in each case proportionally to the length of the sample container, at approximately the same height above the support region by the guidance device. The guidance device typically holds the sample containers so close to the top that these cannot fall out of the guidance device during mixing.

The guidance device preferably contacts the sample container over a small area such that the sample container cannot jam during mixing. The contact area of the guidance device preferably has an annular design, with the sample container in each case touching only an arc section of the annulus at all times during the mixing process. Furthermore, the guidance device can also for example have three suitably arranged contact areas, which can each contact the sample container at the same height. Said contact areas can be designed as radially oriented pins, for example.

The support regions of the container receptacles are preferably arranged on vertically different heights in respect of a horizontal plane and contact the sample container on the base when the latter is inserted, typically on a vertically lowest point of the sample container, or slightly above this, for example in the form of a lateral support in the external base region of the sample container.

What is achieved by arranging the support regions of the two container receptacles at different heights is that sample containers of different heights, which are inserted into the container receptacles, can be flush with one another with respect to a vertically upper region. To this end, the support regions are dimensioned in accordance with the sample containers. This simplifies the insertion of the sample containers into the device, and their removal therefrom, particularly in the case of automated use. This is because the automatic chemical analysis instrument can comprise a transport device, which, dependent on the sample container size, can select an appropriate container receptacle and insert the sample container therein. In an advantageous embodiment the heights of the support regions of the two container receptacles are selected such that an upper edge region of the sample containers respectively comes to rest at the same height. As a result, it is sufficient for the transport device to be able in each case to carry out the same lowering motion in a vertical plane in order to position the sample containers in the receptacle device.

The transport device guides the sample container over the corresponding container receptacle in the process of positioning within the receptacle device. To this end, the transport device may be connected to a computational unit, which can select the appropriate sample receptacle on the basis of the size of the sample container. By way of example, this can be brought about by manual entry or automatically. By way of example, the transport device can grip the sample container on the circumferential side and determine the size of the sample container on the basis of the diameter thereof such that the transport apparatus can independently determine which container receptacle has to be approached. To this end, the computational unit can control the motion, more particularly the path, of gripper jaws of a gripper device in order to determine the diameter of the sample containers. However, this requires that the size of the sample container is unambiguously determinable by the diameter thereof. However, sample containers of known dimensions are typically used by the device, and so identification thereof by the gripper can be dispensed with.

The sample container is guided over the appropriate container receptacle, lowered into the latter and then released. The release can take place in a vertical position in which the sample container does not yet touch the support region of the container receptacle, more particularly just before they touch. This prevents the transport device from being able to damage the sample container as a result of positioning inaccuracies. Alternatively, it is also possible to equip the support region with a resilient material that can be compressed when the sample container is put down. This can absorb tolerances of the positioning inaccuracy. The support region typically has a concave shape so that the sample container can be held in a stable fashion.

The automatic analysis instrument can be embodied as a chromatograph, more particularly as a gas (GC) or liquid chromatograph (LC, HPLC), ion chromatograph (IC, EC) or as a further measurement instrument known to a person skilled in the art from the field of instrumental analysis. To this end, the transport device can be embodied as an autosampler.

It goes without saying that provision can also be made for more than two container receptacles. In a preferred embodiment, the receptacle device comprises four container receptacles; however, provision can also be made for three or more than four container receptacles.

The sample is typically liquid or the main component of the sample is liquid. Since the sample is mixed, the device can also be used to mix suspensions or emulsions, which may, under certain circumstances, transition into solutions as a result of mixing.

However, a person skilled in the art is well aware of the fact that the device can also be used independently of an automatic chemical analysis instrument. The sample containers can also be transferred manually between the device and the analysis instrument. However, the device can also be used for other applications than for preparing samples for chemical analysis. In this respect, a person skilled in the art knows of a large number of fields of application in which a sample must be mixed.

There can preferably be relative motion between the container receptacles and the guidance device in an operational state. When the device is in operation, the receptacles of the sample container move in a substantially horizontal plane in a preferred embodiment, while the guide devices remain stationary. The receptacles preferably have a fixed position relative to one another such that the two receptacles always have the same distance from one another and the same orientation in the horizontal plane during the motion in the operational state. As a result, a sample container inserted into the container receptacle, more particularly a vertically lower region of the sample container, can be put into motion. The motion is preferably cyclical and forms a closed path such that the sample material in the sample container is mixed by the non-constant accelerations, which, inter alia, act on the sample material.

In principle, the motion of the support regions can also be in a non-horizontal plane; in particular, a movement path on an angled plane or as a free spatial movement path (like a roller coaster) is also feasible.

Alternatively, the guidance devices can also be put into motion if the support regions are stationary.

The receptacle device preferably comprises a moveable basic body, on which at least two container receptacles are formed as recesses in the basic body. To this end, the recesses can be arranged at different heights. Here, the basic body can have an integral design. Furthermore, there is the option of providing inserts by means of which the height of the support regions can be varied (see below).

The basic body preferably comprises at least one platform that forms a container receptacle. As a result, an individual receptacle device corresponding to the utilized sample containers can be produced in a simple fashion during production, by assembling one or more different platforms in an appropriate combination with the basic body. This is particularly advantageous when e.g. two or more different sample container dimensions are utilized in a laboratory. The basic body is preferably guided in a fashion secured against twisting such that the former cannot carry out a rotational movement during the mixing process. As a result, the container receptacles each have the same orientation (e.g. directed northward) in the horizontal plane when the device is in operation. To this end, the basic body is preferably forcibly guided by a cam control.

In variants or in combination, the basic body itself can also assume the function of the container receptacles. This is because, depending on the container dimensions, the platform may be dispensed with. The device can be designed such that use can be made of a very large sample container without using a platform.

The platform is preferably embodied in an interchangeable fashion and is more particularly arrangeable in a recess of the basic body. This allows the platform or platforms to be replaced by the user himself, depending on the utilized sample containers. It is also possible to dispense with a platform depending on the sample container dimensions because the recesses in the basic body are suitable both as container receptacle and as receptacle for the platforms. This results in a modular design of the receptacle device. By way of example, a provider can supply a set of different platforms together with the device, or offer these as an accessory, so that the user can quickly and cost-effectively match the device to the respective sample containers. The platforms preferably have a circular-cylindrical shape, with of course other shapes also being feasible. To this end, the platforms preferably have a male thread in a lower region that can interact with a female thread in the basic body. The thread preferably has a slightly conical shape in the axial direction such that a platform is held in an interlocking and force-fit fashion in the basic body and thus does not detach from the basic body during a mixing process. In order to achieve the necessary torque, the platform can have two parallel flattened regions at right angles to the rotational axis of the circular cylinder, whereby the platform can be screwed tight into the basic body by means of a corresponding fork wrench. Furthermore, provision can also be made for a bayonet catch for fixation purposes. A person skilled in the art is aware of a multiplicity of further suitable techniques for fixing the platforms onto the basic body.

The platforms can also be dispensed with in variants. In this case the basic body can be equipped with the corresponding container receptacles.

The container receptacles can preferably be put into an eccentric translational orbital motion. The container receptacles can particularly preferably be put into a circular eccentric translational orbital motion, with, however, an elliptic or other orbital motion also being feasible. However, a circular path is easiest to put into practice from a technical point of view and the sample containers are guided in an improved fashion during the mixing process. As a result, the motion of the container receptacles is substantially guided on a circular path, with the alignment of the container receptacles being constant in each case, i.e. the container receptacles preferably do not rotate about their own axes as a partial motion during the mixing process. As a result, a centrifugal force on the sample in the sample container does not remain constant during the mixing process but rather changes constantly. This brings about largely optimum mixing of the sample.

In variants, the container receptacles can also be arranged radially on an eccentrically rotating disk.

The receptacle device preferably comprises a diaphragm (50) with openings that form the guidance devices for holding the sample containers (41-44) in a region situated above the support regions. The diaphragm is preferably arranged in a stationary fashion above the support regions. The diaphragm is preferably designed as a horizontally oriented plate with circular openings. The sample containers are guided to the support region when inserted through the openings. In the inserted state, the containers are guided by the edge region of the openings on an upper region of the sample container. To this end, the openings can have a diameter of the order of the diameters of the sample containers; however, a diameter of the openings is preferably slightly larger than a diameter of the sample containers. The openings have diameters that correspond to the sample containers, i.e. the openings need not all have the same diameter. The diaphragm can accordingly be designed in an interchangeable fashion such that it can also be matched to the sample container dimensions.

During the mixing process, the sample container is now put into an eccentric translational orbital motion by the container receptacle, with an upper region of the sample container being held substantially stationary by the opening of the diaphragm. As a result, an axis of the sample container describes the surface of a cone during the mixing process, whereby mixing the sample can be further optimized. To this end, the support regions of the container receptacles preferably have a concave shape such that the base of the sample containers remains in contact with the support region during the mixing process. By way of example, if the sample containers have a hemispherical shape in the lower region, the concave shape of the support region for example has a spherical cup shape with a slightly larger radius, with the spherical cup at most describing a hemisphere. In an alternative embodiment the sample containers can have a central pin, projecting axially downward, on the base thereof, which pin can be inserted in a fitted fashion into an opening in the support region. Additionally, provision can be made for an interlocking or force fit of the pin with the opening. This allows the sample container to be held in the support region during the mixing process.

In variants, the diaphragm can also be dispensed with. In this case, the support regions of the container receptacles can have a shape in which a substantial part of the sample containers is held and in the case of which said sample containers cannot leave the container receptacle during the mixing process. However, as a result, an axis of the sample container would substantially describe the surface of a cylinder during the mixing process.

A relative position between a support region and an opening of the diaphragm is preferably determined in a rest position. A relative arrangement between a support region and an opening changes periodically during the operation of the device. The rest position is now defined as an unambiguous position of a support region with respect to an opening of the diaphragm. This allows the transport device to guide a sample container into the device, or remove it therefrom, with the same orientation in each case. It is advantageous, particularly during the insertion, that a relative position between the opening of the diaphragm and the corresponding support is unambiguous for a transport apparatus such that the support region is also hit during the insertion of the sample container through the opening.

Alternatively, it is also possible to dispense with the determined rest position. In order to ease the positioning of the sample container in this case, the support region can have correspondingly larger dimensions.

A center point of one of the plurality of openings is, in the rest position, preferably in each case arranged perpendicularly above a center point of a corresponding support region. As a result, an axis of a sample container describes a shape of an oblique cone during a mixing process, with a surface line substantially perpendicular to the rotational plane. As a result, each angular position between a maximum tilt and a vertical orientation is assumed by the sample container while the device is operational. The center points of the opening and of the corresponding support region being on a vertical axis in the rest position affords the possibility of inserting the sample containers perpendicularly into the container receptacles. As a result, loading and unloading by the transport device in particular is simplified because the sample containers can respectively be guided perpendicularly for loading and unloading the container receptacles.

In variants, the support region can have a conical shape and size that allows perpendicular insertion of the sample containers onto the support region in every position of the receptacles. By way of example, a platform may have a support region to this end, which is situated at least partly perpendicularly under a center point of the corresponding opening of the diaphragm in every position. Thus the sample container, particularly once it is released by the transport device, is automatically guided during insertion of said container into the stable state in the center of the support region as a result of the conical shape.

The basic body is preferably in the rest position on the orbit. This achieves a particularly simple embodiment of the device because the position on the orbit as it were constitutes a "natural" position of the basic body.

In variants, the basic body can also assume a centralized rest position, from which it is deflected during the mixing process.

The device preferably comprises a sensor for determining the rest position. The transport device can preferably tap the signals from the sensor, which allows the coordination of a gripper to be controlled. The sensor can be embodied in a fashion known to a person skilled in the art.

If the rest position with respect to the eccentric motion is situated as a central position in the rotational plane, i.e. if the rest position is unambiguous, the sensor may also be dispensed with.

The device preferably comprises a drive unit. The drive unit can be embodied in a conventional fashion. To this end, the basic body can have a recess centrally on the underside, into which a cam, which is rotatably mounted eccentrically in a horizontal plane, can engage. To this end, the knob can be arranged eccentrically on a rotatably mounted plate. The knob can be rotated via a belt or a gearwheel drive by means of an electric motor. The drive is preferably brought about via a belt because a belt drive is more robust with respect to vibrations as a result of the option of pretension. In this respect, a person skilled in the art knows of further suitable drive options.

In variants, the device can be driven by an external drive unit.

The drive unit is preferably controllable by means of the sensor such that the rest position is approachable. This further simplifies the gripping of the sample container by a transport device.

Further advantageous embodiments and feature combinations of the invention emerge from the subsequent detailed description and the totality of the patent claims.

The device preferably comprises a control unit for controlling the drive unit. As a result, the drive unit can be actuated differently depending on the sample material to be mixed. Here, the rotational frequency of the receptacles of the sample containers is controlled or set. To this end, a constant rotational frequency is typically set; however, it is also feasible to provide a non-constant rotational frequency, which could further improve the mixing. By way of example, the drive unit could be actuated such that the rotational frequency changes continuously, the rotary movement is superposed by vibrations and/or the rotational direction changes in an alternating fashion.

Alternatively, provision can also be made for a single constant setting of the drive unit.

BRIEF DESCRIPTION OF THE DRAWINGS

In the drawings used to explain the exemplary embodiment.

In principle, equivalent parts have in the figures been provided with the same reference sign.

WAYS OF IMPLEMENTING THE INVENTION

Figure 1:
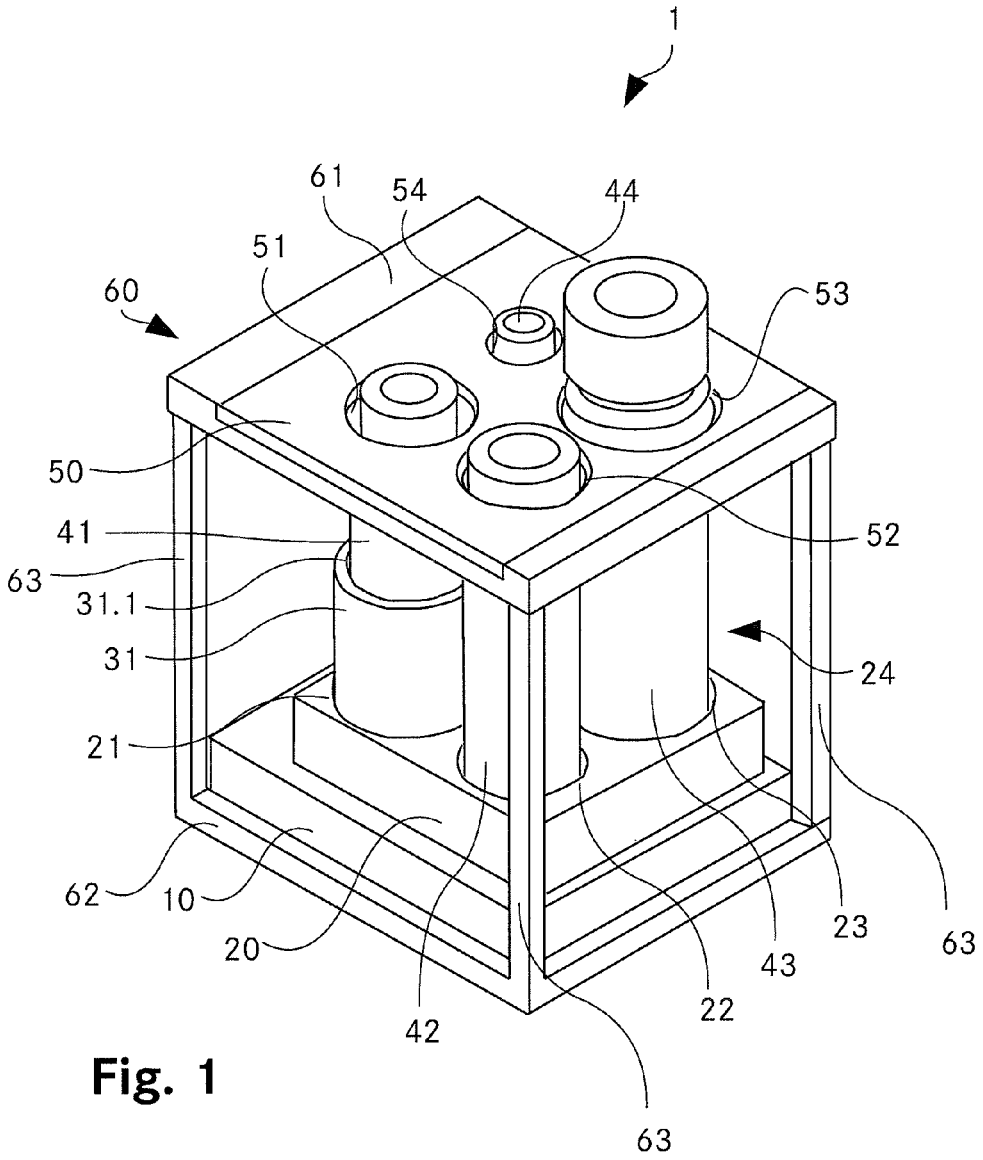
FIG. 1 shows an oblique view of a device according to the invention for mixing a sample.

FIG. 1 shows a device according to the invention for mixing a sample 1. Said device comprises a base body 10 with a drive unit (not illustrated). A basic body 20 is movably mounted on the base body 10. The mounting permits a translational orbital motion of the basic body 20 relative to the stationary base body 10. The basic body 20 is thus guided without rotation on a circular path. The basic body 20 has four circular cylindrical recesses 21-24 on its upper side, with recess 24 not being visible in FIG. 1. The circular cylinder axes of the recesses 21-24 are arranged in a square. Situated in the recess 21 is a circular cylindrical platform 31, which has a male thread in a lower region, by means of which it is screwed (not illustrated) into the recess 21 having a correspondingly shaped female thread. The platform 31 in turn has a cylindrical recess 31.1, oriented axially with respect to the platform, into which a sample container 41 can be inserted. The sample container 41 has an external diameter that is smaller than the recess 31.1 of the platform 31, and so the sample container 41 can be tilted in the recess 31.1 through a certain angular range (see below). The recess 22 does not comprise a platform. The sample container 42 is sufficiently high, whereby the recess 22 itself can serve as support region for the sample container 42. The containers 41 and 42 are arranged flush with respect to one another at the top by means of the platform 31. No platform is provided in the recess 23 either because the sample container 43 likewise has a sufficient height. The sample container 43 projects above the sample containers 41 and 42. The sample container 44 in turn is arranged on a platform, which however is not visible here, and is likewise arranged flush with sample containers 41 and 42 over a top edge. In terms of its design, the platform substantially corresponds to the platform 31 of the sample container 41, with the diameter being smaller and it having a greater height than the platform 31 because sample container 44 is smaller than sample container 41. The platforms are provided in an interchangeable fashion, and so the user can match these to a specific application. As already noted above, the recesses can each have different diameters in the basic body 20, and so they are suitable for sample containers 41-44 with different diameters.

The device 1 furthermore comprises a diaphragm 50 with four openings 51-54. The diaphragm 50 is held in a diaphragm holder 60 in an interchangeable fashion and for example secured by means of screws (not illustrated). The diaphragm holder 60 comprises a rectangular frame 61 as a receptacle for the diaphragm 50, a base plate 62, to which the base body 10 is connected, and four supporting pillars 63, which are connected, projecting perpendicularly downward over a top end in each case, to the corner regions of the frame 61 and connected to the base plate 62 at a bottom end.

In FIG. 1, the openings 51-54 are arranged perpendicularly over the recesses 21-24 of the basic body 20 and have diameters that are approximately proportional to the diameters of the recesses 21-24. The sample containers 41-44 in each case project at least partly through the corresponding openings 51-54 and are thus held in a substantially stationary fashion in the upper region during a mixing process. In FIG. 1, the basic body 20 is in the so-called rest position, whereby the sample containers 41-44 are each oriented perpendicularly.

A support region, which is embodied either as a recess 21-24 of the basic body 20 or as a recess 31.1 of a platform 31, is embodied such that a sample container 41-44 can be tilted in a specific angular range. This angular range depends on the diameter of a sample container 41-44, the dimensions of the recess 21-24 or 31.1, the height between support region and diaphragm 50, and on the maximum deflection of the basic body 20 relative to the base body 10. In the case of given boundary conditions, a person skilled in the art can determine the dimensions (height and diameter) of the recess without problems such that the sample containers 41-44 cannot jam during the mixing process.

Figure 2A:
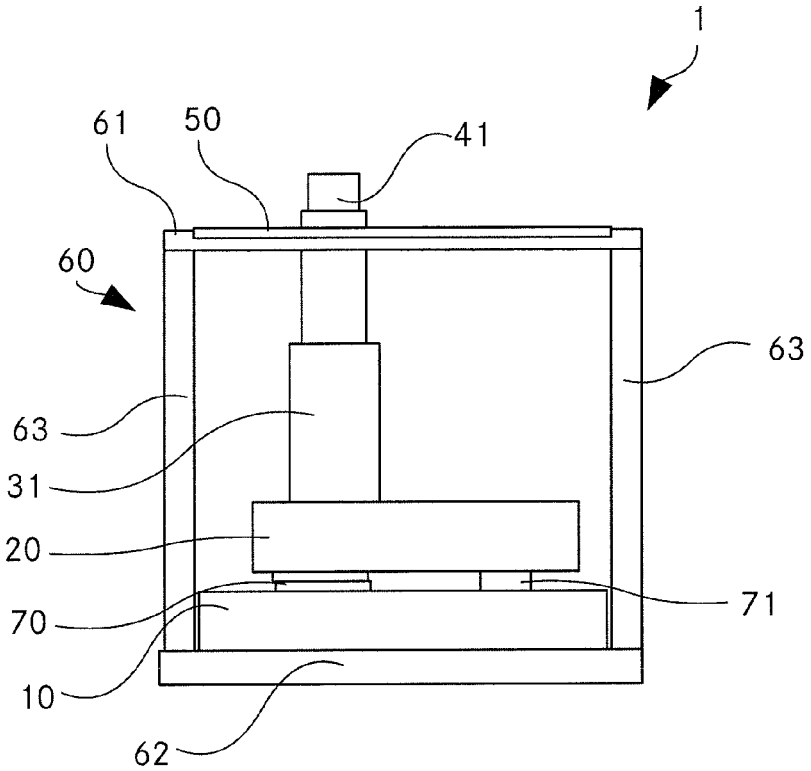
FIG. 2*a* shows a lateral view of the device in a first state.

FIG. 2*a* shows a lateral view of the device 1 as per FIG. 1, but in a different configuration. In contrast to FIG. 1, only one platform 31 has been inserted into the basic body 20 and it supports the sample container 41. Compared to FIG. 1, FIG. 2*a* additionally shows an eccentric drive 70 and a guidance element 71, which are arranged between the basic body 20 and the base body 10. The eccentric drive 70 can put the basic body 20 into an eccentric translational orbital motion, i.e. the basic body 20 oscillates on a circular path with an unchanging orientation. The eccentric drive 70 is driven by an electric motor via a belt (not illustrated) and additionally comprises a sensor for determining the current position. FIG. 2*a* shows the device 1 in the rest position; the (only) sample container 41, which is on the platform 31, is oriented in the perpendicular direction and held laterally in an upper region in the opening 51 (not visible). A sample container 41-44 is typically inserted or removed in this position. The sample containers 41-44 are transferred by means of a transport apparatus (not illustrated), more particularly by means of a transport arm, which can insert the sample containers 41-44 laterally through the openings 51-54. The mixing process can start after the insertion, whereby the basic body 20 guides the lower regions of the sample containers 41-44 on a circular path while the upper regions of the sample containers 41-44 are held in the openings 51-54 in a substantially stationary fashion.

Figure 2B:
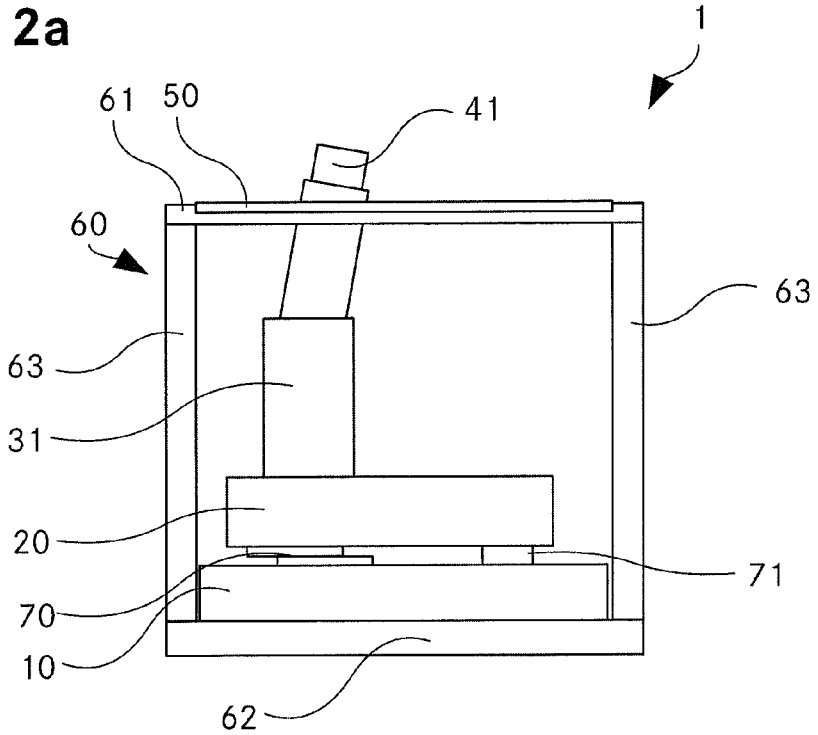
FIG. 2*b* shows a lateral view of the device in a second state with sample containers tilted vertically.

FIG. 2*b* substantially corresponds to FIG. 2*a*, with the eccentric drive 70 however having completed half a revolution. The sample container 41, which is held by the opening 51 (not visible), is in an oblique position, more particularly in the maximum oblique position, and is finally returned into the vertical position as per FIG. 2*a* as result of the continuing motion of the basic body 20.

A person skilled in the art understands that the embodiment of the device as per FIGS. 1-2*b* is merely an example of a possible embodiment. The design implementation can be varied as desired.

In conclusion, it should be noted that, according to the invention, a device for mixing a sample is developed, which is suitable for sample containers with different dimensions and allows optimum mixing of the sample.

| List of reference signs | |
|---|---|
| 1 | Device for mixing a sample |
| 10 | Base body |
| 20 | Basic body |
| 21-24 | Recess |
| 31, 32 | Platform |
| 31.1 | Recess |
| 41-44 | Sample container |
| 50 | Diaphragm |
| 51-54 | Opening |
| 60 | Diaphragm holder |
| 61 | Frame |
| 62 | Base plate |
| 63 | Supporting pillar |
| 70 | Eccentric drive |
| 71 | Guidance element |

The invention claimed is:

1. Device for mixing a sample comprising:

a movable basic body having at least a first support region and a second support region formed as recesses thereon for holding at least a first and a second sample container, the recesses each having a support surface for supporting a respective one of the sample containers;

a guidance device arranged above the movable basic body and formed as a diaphragm with at least a first opening and a second opening for laterally guiding the at least first and second sample containers;

a cylindrical platform inserted into one of the recesses that forms a support surface for supporting a respective sample container, wherein a vertical distance between the diaphragm and the support surface of at least one of the recesses and a vertical distance between the diaphragm and the support surface of the platform are different;

wherein in an operational state the movable basic body undergoes motion relative to the guidance device by a drive unit.

2. Device according to claim 1, wherein the platform is embodied in an interchangeable fashion into one or more of said recesses.

3. Device according to claim 2, wherein the platform is interchangeable via a threaded connection between the platform and a respective recess.

4. Device according to claim 1, wherein said moveable basic body is put into an eccentric translational orbital motion in the operational state by said drive unit.

5. Device according to claim 4, wherein said moveable basic body is put into a circular eccentric translational orbital motion in the operational state by said drive unit.

6. Device according to claim 1, wherein a center point of each of the first and second openings is, in a rest position, arranged perpendicularly above a center point of the respective support region or container receptacle.

7. Device according to claim 1, wherein the drive unit is coupled to the moveable basic body.

8. Device according to claim 7, wherein the device comprises a control unit for controlling the drive unit.

* * * * *